US006712586B2

(12) United States Patent
Koyano et al.

(10) Patent No.: US 6,712,586 B2
(45) Date of Patent: Mar. 30, 2004

(54) GAS SUCTION PUMP DEVICE, GAS FEED ADAPTER AND GAS ALARM UNIT

(75) Inventors: Junichi Koyano, Tokyo (JP); Shuji Tajima, Tokyo (JP); Yasunori Takei, Tokyo (JP); Takuo Aida, Tokyo (JP)

(73) Assignee: Riken Keiki Co., Ltd., Tokyo (JP)

( * ) Notice: Subject to any disclaimer, the term of this patent is extended or adjusted under 35 U.S.C. 154(b) by 46 days.

(21) Appl. No.: 10/201,068

(22) Filed: Jul. 22, 2002

(65) Prior Publication Data

US 2003/0138329 A1 Jul. 24, 2003

(30) Foreign Application Priority Data

Jan. 24, 2002 (JP) ..... 2002-015756

(51) Int. Cl.[7] ..... F04B 49/00; F04B 53/00; F04B 17/03

(52) U.S. Cl. ..... 417/63; 417/234; 417/313; 417/411

(58) Field of Search ..... 417/411, 413, 417/234, 313, 63

(56) References Cited

U.S. PATENT DOCUMENTS 2,960,321 A * 11/1960 Stoots, Jr. ..... 261/30
3,410,059 A * 11/1968 Garnier ..... 73/863.23
5,215,445 A * 6/1993 Chen ..... 417/313
5,257,913 A * 11/1993 Schwarzer et al. ..... 417/411
6,422,835 B1 * 7/2002 Beauchard ..... 417/411

OTHER PUBLICATIONS

U.S. patent application Ser. No. 09/684,320, Filed: Oct. 10, 2002; Inventor: Juniti Koyano, et al; Entitled: Portable Gas and its Cradle, (pp 1–14 and 11 sheets of drawings).

* cited by examiner

*Primary Examiner*—Charles G. Freay
(74) *Attorney, Agent, or Firm*—Frishauf, Holtz, Goodman & Chick, P.C.

(57) ABSTRACT

The invention provides a gas suction pump device equipped with a casing having a substantially rectangular frame-like sectional shape and formed slenderly in a gas flowing direction and into a size holdable by grasping with a hand, a control circuit board provided in the casing so as to extend in a longitudinal direction along the upper wall of the casing, a pump unit arranged in a region on the side of one side wall on the lower side of the control circuit board in a state that one end and the other end of a gas flow path defined by the pump unit have been connected to a gas inlet port and a gas outlet port, respectively, and a battery fitting chamber provided in a region on the side of the other side wall. The invention also provides a gas alarm unit constructed by connecting the above pump device to a portable gas alarm device provided with a specific gas feed adapter through a connecting tube.

20 Claims, 9 Drawing Sheets

GAS SUCTION PUMP DEVICE, GAS FEED ADAPTER AND GAS ALARM UNIT

BACKGROUND OF THE INVENTION

1. Field of the Invention

The present invention relates to a gas suction pump device, a gas feed adapter and a gas alarm unit.

2. Description of the Background Art

There are generally frequent occasions when it may be possible in, for example, underground job sites or gateways, or other places where persons enter, or working regions that air in an environmental atmosphere is in a dangerous state, or will become a dangerous state, such as occasions when harmful gases such as carbon monoxide and hydrogen sulfide gases may possibly be contained in air in such an environment, or when the oxygen gas concentration in air may possibly be lowered.

When the air in the environmental atmosphere has become a dangerous state to persons due to high concentration of the dangerous gases contained or low oxygen gas concentration, it is necessary to sense the fact.

From such a demand, there have been proposed various types of portable gas alarm devices to date. As such portable gas alarm devices, for example, those having a structure that a sucking means such as a pump is installed in a gas alarm device body, and air in the objective space is forcedly sucked by this sucking means to perform the concentration measurement of a gas to be detected, and those of the so-called "diffusion type" that air in the objective space is introduced by natural diffusion are known.

However, such a portable gas alarm device cannot be used in a place where no person can enter because the portable gas alarm device basically requires that a person should enter the place to perform the concentration measurement of dangerous gases in order to confirm the safety of air in an environmental atmosphere.

Therefore a method is used in which a sucking device such as a pump is connected to the portable gas alarm device so as to suck air in the objective space to perform the concentration measurement of the dangerous gases up to the gas alarm device body by the sucking device.

Since the conventional sucking devices are generally large in size and heavy, however, they involve problems that they are considerably unhandy to carry and make a great obstacle to practice the intended work or the like.

In addition at the actual situation, such a sucking device is unsuitable for use as a sucking means that is connected to the portable gas alarm device, because it requires much time or labor in maintenance work such as filter exchange or pump exchange.

SUMMARY OF THE INVENTION

The present invention has been made on the basis of the foregoing circumstances.

It is the first object of the present invention to provide a gas suction pump device which is easy to be fabricated as a small-sized one handy to carry and high in convenience for use.

The second object of the present invention is to provide a gas feed adapter by which air from such a gas suction pump device can be surely fed to a gas detecting part of a portable gas alarm device.

The third object of the present invention is to provide a portable gas alarm unit which makes good use of such a gas suction pump device and is high in convenience for use.

The first object of the present invention can be achieved by any one of the following constitutions [1] to [8].

[1] A gas suction pump device suitable for being connected by a connecting tube to a portable gas alarm device for use, which comprises:

a casing having a substantially rectangular frame-like sectional shape composed of 2 side walls opposite to each other, and upper and lower walls which connect the side walls to each other, and formed slenderly in a gas flowing direction and into a size holdable by grasping with a hand;

a control circuit board provided in the casing so as to extend in a longitudinal direction along the upper wall;

a pump unit arranged in a region on the side of one side wall under the control circuit board, in which one end and the other end of a gas flow path defined by the pump unit and extending in the longitudinal direction of the casing communicate with a gas inlet port opened forward of the casing and a gas outlet port opened backward of the casing, respectively; and a battery fitting chamber provided in a region on the side of the other side wall.

[2] The gas suction pump device according to the constitution [1], wherein the pump unit is composed of a pump and a pump driving motor provided integrally with the pump, and wherein the pump is located in the vicinity of one side wall in the casing, and the pump driving motor is arranged in a state located in the vicinity of the other side wall.

[3] The gas suction pump device according to the constitution [2], wherein the pump making up the pump unit has a gas discharge quantity of 0.2 to 0.5 L/min.

[4] The gas suction pump device according to any one of the constitutions [1] to [3], wherein a driving power source is a battery.

[5] The gas suction pump device according to any one of the constitutions [1] to [4], wherein a recessed part for receiving an end part of the connecting tube is formed in the casing, and a connecting terminal to which the connecting tube is connected is provided at the gas outlet port in the recessed part in a state projected backward from the rear wall thereof.

[6] The gas suction pump device according to any one of the constitutions [1] to [5], wherein a branched gas flow path opened upward is defined in a gas flow path forming member connecting the pump unit to the gas outlet port, and a pressure sensor is connected to the branched gas flow path in a state arranged on the control circuit board side of the gas flow path forming member.

[7] The gas suction pump device according to any one of the constitutions [1] to [6], wherein the casing is formed by joining a front case with a rear case detachably to each other, and an anti-detaching metal band for preventing both front case and rear case from detaching from each other is fitted on the joined area between the front case and the rear case.

[8] The gas suction pump device according to the constitution [7], wherein the anti-detaching preventing metal band is fitted in a state that both ends thereof overlap each other and fixed to the casing by a screw at a position where both ends overlap each other.

The second object of the present invention can be achieved by the following constitution [9].

[9] A gas feed adapter for connecting the gas suction pump device according to any one of the constitutions [1] to [8] through a connecting tube to a portable gas alarm device equipped with a plurality of gas sensors which detect gases of different kinds from one another, which comprises:

a casing having an engaging part and detachably engaged with a gas alarm device body, wherein a gas feed port common to the respective gas sensors in the gas alarm device body is defined in one outer end wall of the casing, a connecting terminal to which the connecting tube is connected is also fitted so as to project outward, and a gas outlet for opening the internal space in the casing to the air is defined in the other outer end wall, and wherein a main gas inlet passage extending zigzag from one to the other in the casing is formed in the casing, and a plurality of branched gas inlet passages independent of one another for introducing air in the objective space to perform the measurement of gases into the respective gas sensors in the gas alarm device body are formed in the main gas inlet passage.

The third object of the present invention can be achieved by any one of the following constitutions [10] to [14].

[10] A gas alarm unit comprising the gas suction pump device according to any one of above the constructions [1] to [8], a connecting tube connected to the gas suction pump device at an end thereof and a portable gas alarm device connected to the other end of the connecting tube through the gas feed adapter according to the construction [9], into which air in the objective space to perform the measurement of gases is introduced from the gas suction pump device.

[11] The gas alarm unit according to the construction [10], wherein the portable gas alarm device comprises a substantially box-like casing composed of a case body provided with a fitting member fixing part in which a fitting member for fitting on a person's body to carry the alarm device is installed and having an opening at a lower part, and a lid for closing the opening in the case body, and a gas detecting part is formed at one side surface of the casing in such a manner that a plurality of the gas sensors are arranged side by side in a plane direction of said one side surface.

[12] The gas alarm unit according to the construction [11], wherein a power unit composed of a circuit board flat in shape, on which a secondary battery as a driving power source, a charging terminal for charging the secondary battery and a current limiting resistance are mounted, and an insulating cover provided so as to cover the secondary battery and the current limiting resistance on the circuit board is provided in the casing in such a manner that the circuit board extends in parallel with the lid in the casing, and wherein an alarm annunciating mechanism that raises an alarm when the concentration of a gas detected by the gas sensor exceeds a reference value preset about the gas, and a display mechanism for displaying the concentration of the gas detected by the gas sensor are arranged so as to stand in a plane direction of the circuit board in a state that the alarm annunciating mechanism is located over the secondary battery in the power unit.

[13] The gas alarm unit according to the construction [11] or [12], wherein a plurality of the gas sensors are fixed and held by a gas sensor fixing frame member, in which gas inlet ports for the respective gas sensors have been formed in a state independent of one another, in the gas detecting part.

[14] The gas alarm unit according to any one of the constructions [11] to [13], wherein 4 gas sensors are arranged in the gas detecting part, and the objective gases to be detected by the gas sensors are gases of oxygen, hydrogen sulfide, carbon monoxide and hydrocarbon.

According to the gas suction pump device of the above-described construction, the casing is in the form holdable by grasping by a hand, and the constituent members of the pump device are rationally arranged in a state that a dead space in the casing becomes as small as possible, whereby the gas suction pump device itself can be provided as a small-sized and light-weight one while retaining basically necessary functions. Accordingly, the gas suction pump devices are excellent in portability, and so actually high in convenience can be achieved.

According to the gas feed adapter of the above-described constitution, a state substantially equal to natural diffusion can be realized as the main gas inlet passage for feeding air in the objective space to perform gas measurement to a gas alarm device is opened to the atmosphere or air though the air is forcedly introduced by a gas suction pump device. In addition, the main gas inlet passage is formed so as to extend zigzag, and the branched gas inlet passages are formed corresponding to the respective gas sensors, whereby air introduced by the gas suction pump device can be surely fed to the respective gas sensors.

According to the portable gas alarm units of the above-described constructions, the portable gas alarm device is fitted to the body of a person and carried together with the body by the person because the pump device making up the gas alarm unit has high convenience while retaining the necessary functions, and moreover the pump device can be held for use by grasping it by a hand, whereby the gas alarm unit has extremely high convenience for use as a portable gas alarm unit. Accordingly, concentration measurement of dangerous gases can be performed even in a place where no person can enter, and high safety can be achieved.

BRIEF DESCRIPTION OF THE DRAWINGS

The above and other objects, features and advantages of the present invention will become apparent from the following description and the appended claims, taken in conjunction with the accompanying drawings, in which:

DETAILED DESCRIPTION OF THE PREFERRED EMBODIMENTS

The present invention will hereinafter be described by reference to the drawings.

Figure 1:
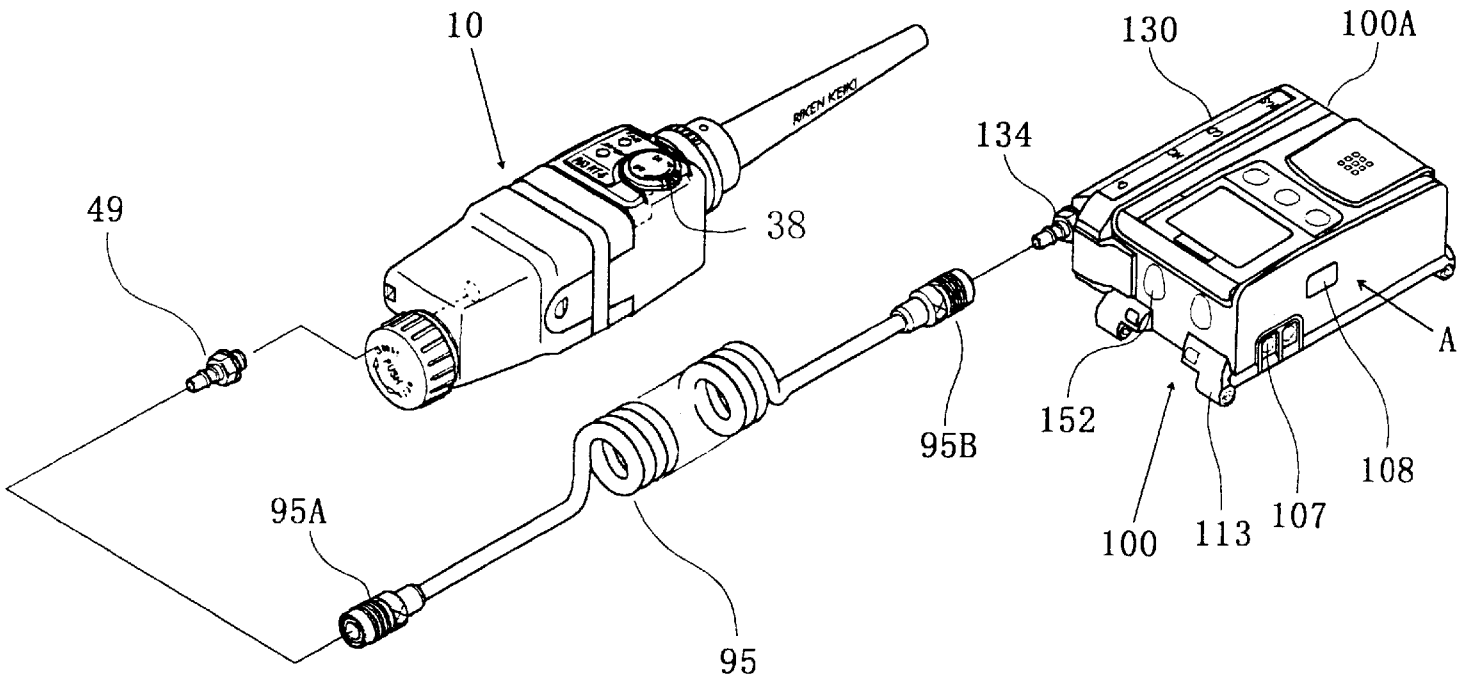
FIG. 1 illustrates an example of the construction of a gas alarm unit according to the present invention.

FIG. 1 illustrates an example of the construction of a gas alarm unit according to the present invention. This gas alarm unit is constructed by a gas suction pump device 10, a connecting tube 95, a gas feed adapter 130 and a portable gas alarm device 100 in which the gas feed adapter 130 is installed.

A gas feed-side socket 95A, which forms a gas feed-side coupler by being connected to a gas feed-side plug 49 as a connecting terminal provided in the gas suction pump device 10, is provided at an end of the connecting tube 95, and a gas inlet-side socket 95B, which forms a gas inlet-side coupler by being connected to a gas inlet-side plug 134 provided in the gas feed adapter 130, is provided at the other end of the tube 95.

The length of the connecting tube 95 can be suitably selected within the limit of, for example, 10 m. In an example illustrated, an extensible spiral tube, which is in a state spirally wound in a natural state, is used. This connecting tube 95 has, for example, an extended length of 1 m and an inner diameter of 2.5 mm.

<Gas Suction Pump Device>

Figure 2:
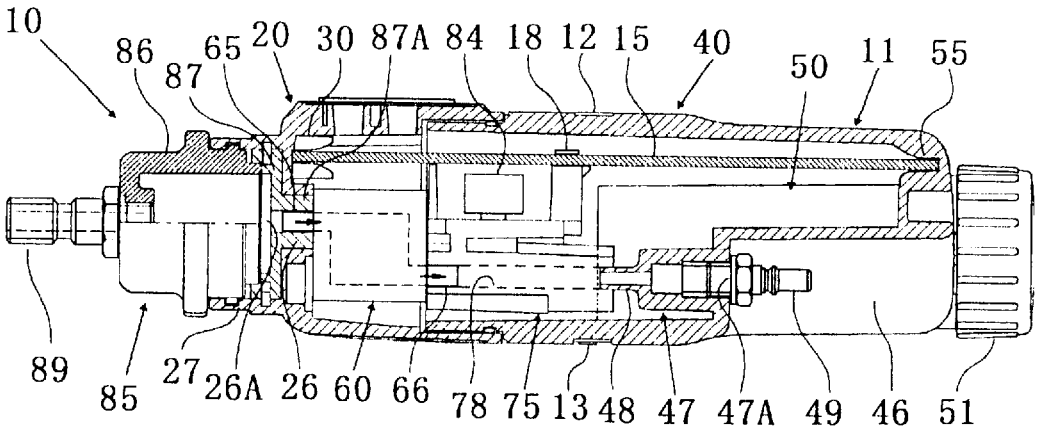
FIG. 2 is a cross-sectional view schematically illustrating the construction of an exemplary gas suction pump device according to the present invention.
Figure 3:
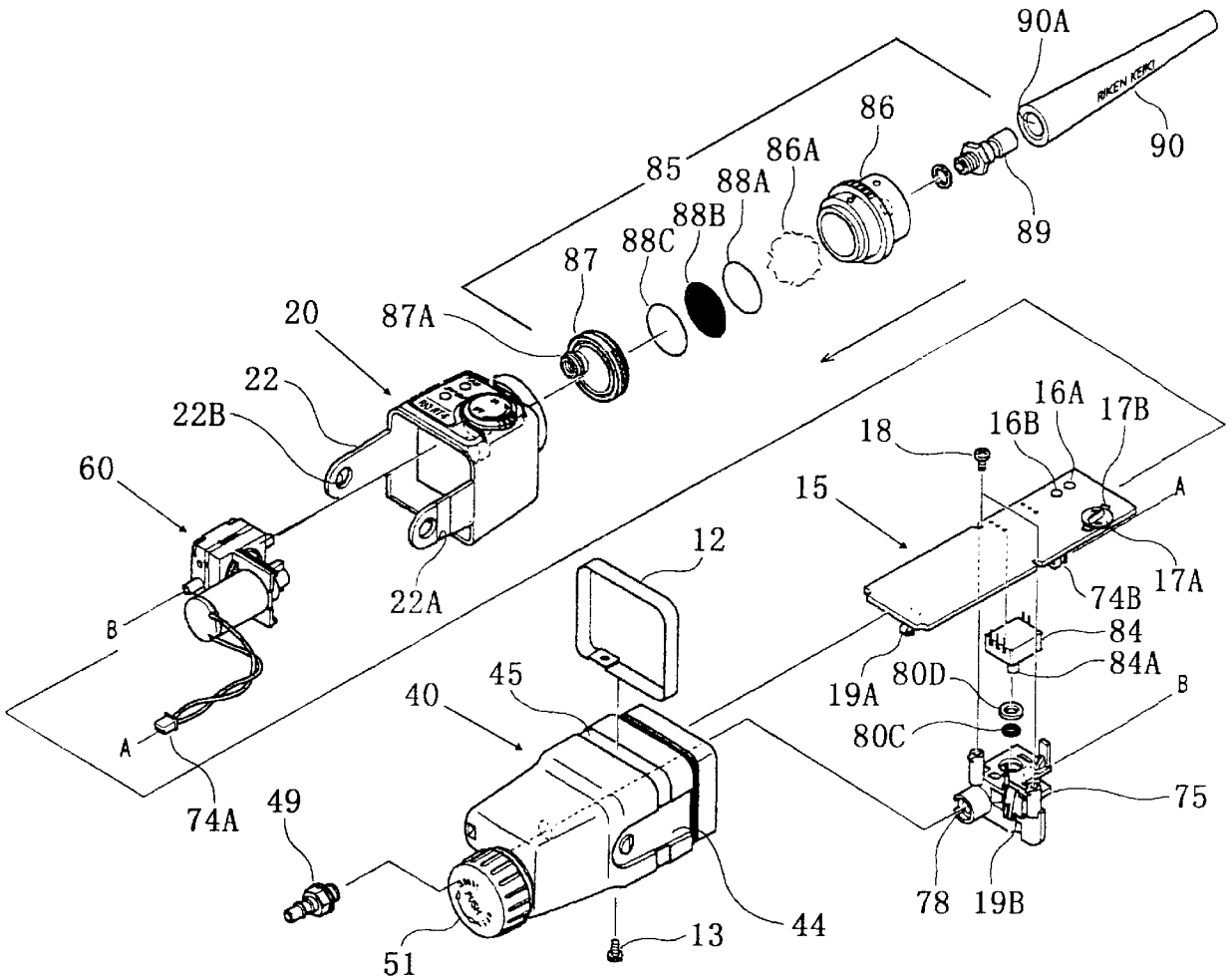
FIG. 3 is an exploded perspective view of the gas suction pump device shown in FIG. 2.
Figure 4:
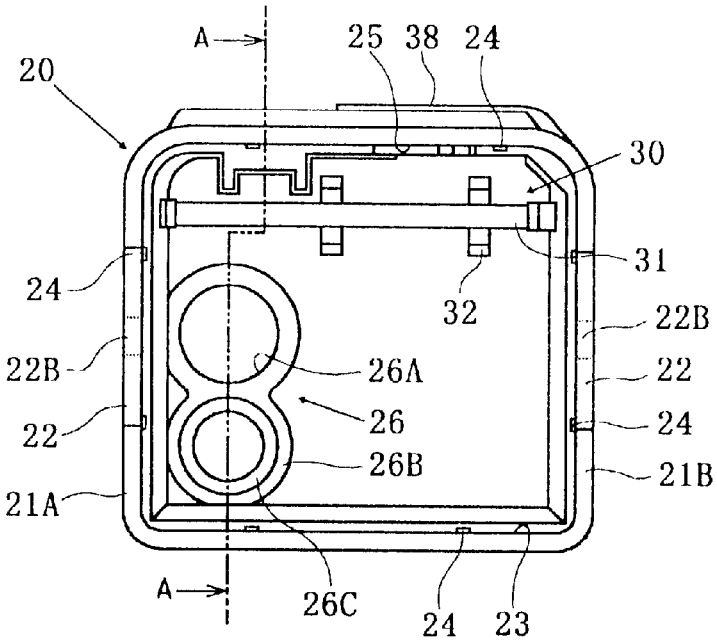
FIG. 4 is a front elevation schematically illustrating the construction of a front case in the gas suction pump device shown in FIG. 2.
Figure 5:
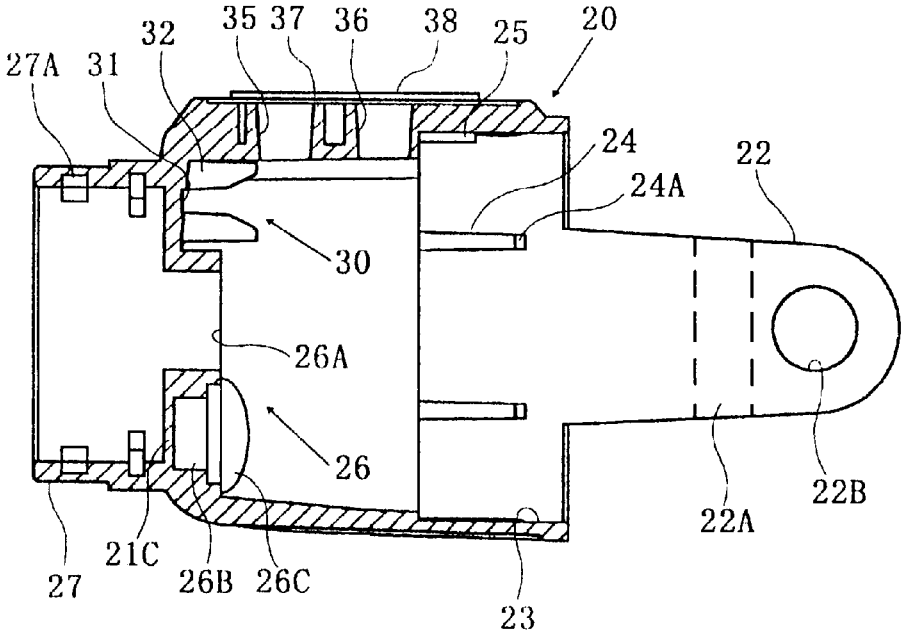
FIG. 5 is a longitudinal cross-sectional view taken along line A—A in FIG. 4.
Figure 6:
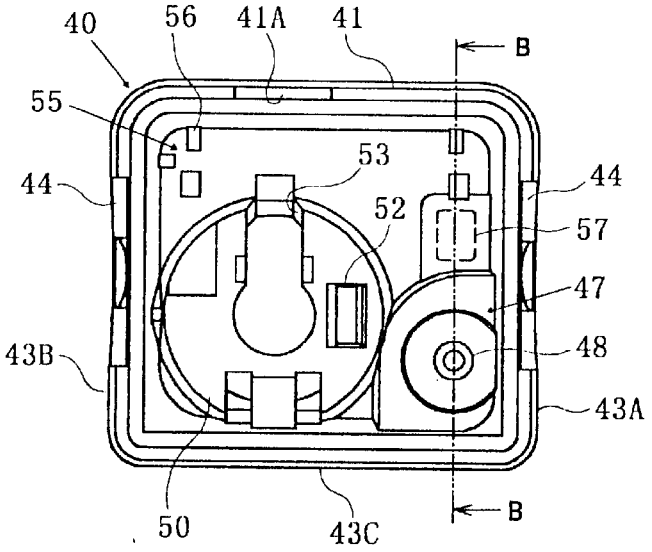
FIG. 6 is a front elevation schematically illustrating the construction of a rear case in the gas suction pump device shown in FIG. 2.
Figure 7:
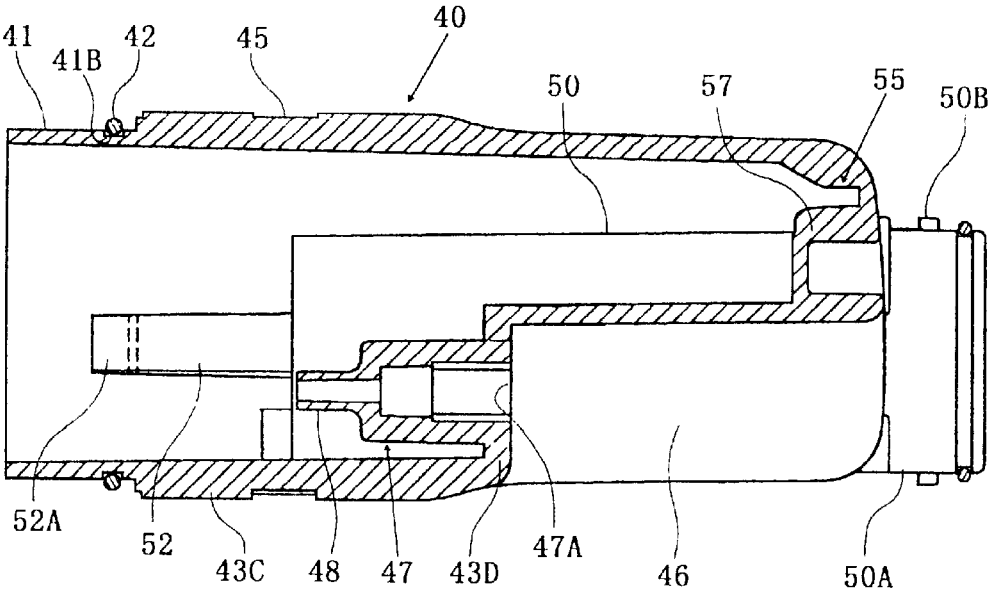
FIG. 7 is a longitudinal cross-sectional view taken along line B—B in FIG. 6.

FIG. 2 is a cross-sectional view schematically illustrating the construction of an exemplary gas suction pump device according to the present invention, FIG. 3 is an exploded perspective view of the gas suction pump device shown in FIG. 2, FIG. 4 is a front elevation schematically illustrating the construction of a front case in the gas suction pump device shown in FIG. 2, FIG. 5 is a longitudinal cross-sectional view taken along line A—A in FIG. 4, FIG. 6 is a front elevation schematically illustrating the construction of a rear case of the gas suction pump device shown in FIG. 2, and FIG. 7 is a longitudinal cross-sectional view taken along line B—B in FIG. 6. In this specification, the left and right direction, upward and downward direction and a direction perpendicular to the drawing in FIG. 2 will hereinafter be referred to as "forward and backward direction", "upward and downward direction" and "width direction", respectively.

This gas suction pump device (hereinafter referred to as "pump device" simply) 10 is equipped with a casing 11 formed by joining a front case 20 with a rear case 40 detachably to each other.

The casing 11 has a substantially rectangular frame-like sectional shape composed of 2 side walls opposite to each other, and upper and lower walls which connect the side walls to each other, and is formed slenderly in the forward and backward direction and into a size holdable by grasping with a hand.

The front case 20 is formed of, for example, a resin and has a substantially box-like shape extending in the forward and backward direction as a whole, and tongue-shaped parts 22, 22 for fitting, which are respectively extending from rear end edges of the side walls 21A, 21B opposite to each other, are formed at the side walls.

In the tongue-shaped parts 22, 22, fitting grooves 22A extending the upward and downward direction are formed at the outer surfaces thereof, and circular through-holes 22B are formed at rear end parts thereof.

A recessed part 23 is formed along the whole periphery of an inner wall surface in the rear end part of the front case 20, and needle-like projection parts 24 extending rearward are formed at the recessed part 23.

The needle-like projection parts 24 each has a tapered part 24A that a rear end inclines so as to narrow toward the rear and are formed by, for example, two in a state spaced with each other on each of 4 wall surfaces. The needle-like projection parts 24 thereby function as guide members for a fitting member 41 of the rear case 40, which will be described subsequently, upon fitting of the rear case 40, and so attachment and detachment between the front case 20 and the rear case 40 can be easily performed.

A tongue-like projection part 25 for prevention of misfitting for fitting the rear case 40 in a correct state is formed on an upper wall surface of the recessed part 23. Fitting between the front case 20 and the rear case 40 is achieved by inserting the rear case 40 in a state that the prescribed face in the fitting part 41 has been turned up.

The rear case 40 is composed of, for example, the same resin as that forming the front case 20 and has a substantially box-like shape extending in the forward and backward direction as a whole, and a recessed part 46 for receiving an end part of a connecting tube 95 to be connected to the portable gas alarm device 100 is formed at a rear part of in one side surface (side surface on facing side of the width direction in FIG. 2).

The fitting part 41 having a shape corresponding to the recessed part 23 of the front case 20 is formed at the front side part of the rear case 40. A groove 41A, in which the tongue-like projection part 25 in the front case 20 will be inserted upon fitting, is formed at a front end edge of the upper surface of the fitting part 41, and an annular groove 41B, in which a sealing member 42 such as, for example, an O-ring is fitted, is formed over the whole peripheral surface at a rear end edge thereof.

Recessed parts 44, 44 each having a shape corresponding to the tongue-shaped parts 22, 22 of the front case 20 are formed in outer surfaces of side walls 43A, 43B of the rear case 40. These are fitted with each other, whereby the front case 20 and the rear case 40 are integrally joined to form the casing 11.

At the joined area between the front case 20 and the rear case 40, a groove 45 for arrangement of a metal band is formed so as to extend over the whole outer peripheral surface continuously with the grooves 22A, 22A in the tongue-shaped parts 22, 22, and an anti-detaching metal band 12 is fitted in the groove 45 in a state that both ends thereof overlap each other and integrally fixed to a lower wall 43C of the rear case 40 by a screw 13 at a position where the both ends overlap each other, whereby detaching of the front case 20 from the rear case 40 can be surely prevented even when the pump device 10 has been dropped by way of example.

The anti-detaching metal band 12 is used in a size that the surface of the casing 11, which tends to carry static electricity because it is formed of the resin, is divided into 2 parts of the front case 20 and the rear case 40 in such a manner that the surface areas of the respective parts are 100 $cm^2$ or smaller, whereby the pump device 10 itself can be so constructed that it does not become a source of catch fire, namely, it satisfies the standard of so-called explosion-proof specification (intrinsically safe explosion proofness).

In the casing 11, a gas inlet part 26 having a gas inlet port 26A opened forward of the casing is formed at a position shifted towards the side of one side wall 21A of the front case 20, and a gas discharge part 47 having a gas outlet port 47A opened backward of the casing is formed at a position opposite to the gas inlet part 26 in the longitudinal direction, where the recessed part 46 of the rear case 40 has been formed.

The gas discharge part 47 has a small-diameter cylindrical part 48 formed so as to extend forward in parallel with the lower wall 43C, and the small-diameter cylindrical part 48 is formed at a position somewhat lower than the level of the gas inlet port 26A.

In the recessed part 46 in the casing 11, a gas feed-side plug 49 as a connecting terminal is arranged in a state projecting backward from the rear wall 43D thereof by being fitted into the gas outlet port 47A. FIG. 7 illustrates a state that gas feed-side plug 49 is removed.

The gas feed-side plug 49 has a gas discharge port smaller than the opening diameter of the gas outlet port 47A and having a structure that the opening diameter thereof is preset to a size that a gas exhaust pressure, by which a pressure sensor 84 connected to a manifold 75 which will be described subsequently is actuated, is achieved, namely, so as to have a so-called capillary structure. The gas exhaust pressure from a pump unit 60 which will be described subsequently can be thereby raised to such an intensity, for example 0.4 kPa, that can be detected by the pressure sensor 84.

In the casing 11, a circuit board-holding mechanism 30 is provided at a position above the gas inlet port 26A on the front wall 21C of the front case 20, and a circuit board-holding mechanism 55 is provided at a position above the gas outlet port 47A on the inner surface of the rear wall 43D of the rear case 40. The circuit board-holding mechanism 30 in the front case 20 and the circuit board-holding mechanism 55 in the rear case 40 are in a state they are located at the same level as each other in the upward and downward direction.

The circuit board-holding mechanism 30 in the front case 20 is formed by arranging 2 holding parts 32, each of which is composed of a pair of pin members provided so as to oppose in the upward and downward direction and has a groove 31 extending in the width direction between the pin members, in a state spaced with each other in the width direction.

The circuit board-holding mechanism 55 in the front case 40 is also fundamentally constructed in the same manner as the circuit board-holding mechanism 30 in the front case 20 by arranging 2 holding parts 56, each of which is composed of a pair of pin members arranged in the upward and downward direction, in a state spaced with each other in the width direction.

A flat plate-like control circuit board 15 is caught to be held by the holding parts 32 in the front case 20 and the holding parts 56 in the rear case 40, thereby being arranged so as to extend in the longitudinal direction (forward and backward direction) in parallel with the upper wall of the casing 11.

On the control circuit board 15, as illustrated in FIG. 3, 2 light sources 16A, 16B each composed of a light emitting diode are mounted at positions in the vicinity of one side edge at the front end edge portion on the upper surface side thereof so as to stand side by side in the forward and backward direction. One light source 16A located on the front edge side and the other source 16B are constructed so as to function as a lamp for indicating a power source and as a lamp for indicating an alarm of lower flow rate, respectively.

Contactor members 17A, 17B for switch are mounted so as to stand alongside of the light sources 16A, 16B with a space in the width direction of the control circuit board 15.

On the other hand, on the lower surface side of the control circuit board 15, a manifold 75, which will be described subsequently, is fixed at a substantially central position in the forward and backward direction by a plurality of screws 18 inserted from the upper surface side of the control circuit board 15, and a pressure sensor 84 connected to the manifold 75 is mounted at a position in front of the fixed position of the manifold 75 in the vicinity of one side edge.

On the control circuit board 15, a connector 74B for connection of the pump unit is mounted so as to stand alongside of the pressure sensor 84 in the width direction, and a minus-side contactor member 19A is mounted at a position in the vicinity of the other side edge at the rear end edge portion of the control circuit board 15.

On the control circuit board 15, an electronic circuit having a function of controlling operations of the respective parts in the pump device 10 as above is provided, and the operations of the pump unit 60, which will be described subsequently, the pressure sensor 84, the lamp 16A for indicating a power source, the lamp 16B for indicating an alarm of lower in flow rate, etc. are controlled by this control circuit board 15.

In the casing 11, a battery fitting chamber 50, in which an AA size dry battery as a driving power source for the pump device 10 is placed, is formed in a region on the side of the other side wall under the control circuit board 15 in such a manner that it extends in the forward and backward direction, and its rear end portion projects rearward from the rear end edge of the rear case 40. At the projected end portion 50A of the battery fitting chamber 50, a cap 51 provided with a metal sleeve is detachably fitted on a connecting projection part 50B formed on the outer peripheral surface thereof, whereby the battery can be exchanged.

In the battery fitting chamber 50, a blade-like support member 52 extending forward from the front surface thereof in parallel with the lower wall 43C is integrally provided. A claw member 52A for interlocking with the manifold 75 is formed at the tip part of this blade-like support member 52.

A guide groove 53 extending in the forward and backward direction is formed in the upper part of the battery fitting chamber 50, whereby the control circuit board 15 is inserted by guiding the minus-side contactor member 19A mounted on the surface thereof to a prescribed position along the guide groove 53 and arranged in the casing 11 in a state connected to the metal sleeve of the cap 51.

In the casing 11, the pump unit 60 is arranged in a region on the side of one side wall under the control circuit board 15 in a state that a gas suction pipe 65 forming one end of a gas flow path defined by the pump unit 60 has been connected to the gas inlet port 26A in the front case 20, and a gas discharge pipe 66 forming the other end of the gas flow path has been connected to the gas outlet port 47A in the rear case 40 through the manifold 75 which is a gas flow path forming member in such a manner that the gas flow path extends in the longitudinal direction of the casing 11.

<Pump Unit>

Figure 8:
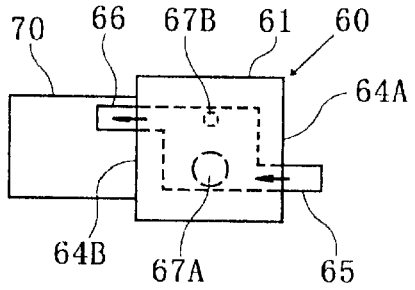
FIG. 8 is a side elevation schematically illustrating the construction of a pump unit in the gas suction pump device shown in FIG. 2.
Figure 9:
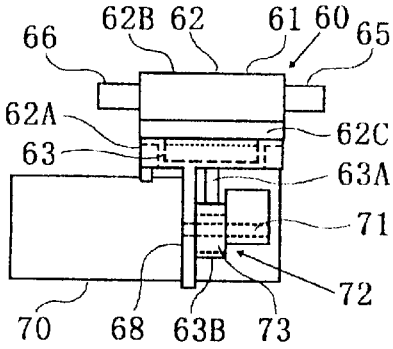
FIG. 9 is a top plan view of the pump unit shown in FIG. 8.

FIG. 8 is a side elevation schematically illustrating the construction of a pump unit in the gas suction pump device shown in FIG. 2, and FIG. 9 is a top plan view of the pump unit shown in FIG. 8.

The pump unit 60 is constructed by a pump 61 of the so-called diaphragm system and a pump driving motor 70 provided integrally with the pump. In FIG. 9, reference numeral 68 indicates a support member for supporting the driving motor 70.

The pump 61 has a pump room 62 having a substantially box-like shape as a whole, and this pump room 62 is equipped with a first pump room 62A and a second pump room 62B partitioned by a partition wall 62C so as to stand side by side in the width direction.

In the first pump room 62A, a diaphragm 63 is airtightly provided in a state extending in parallel with the partition wall 62C and covering an internal space in the first pump room 62A. A drive shaft 63A extending in the width direction is connected to the diaphragm 63, and a sleeve member 63B is integrally provided at the tip of the drive shaft 63A.

In the second pump room 62B, the gas suction pipe 65 and the gas discharge pipe 66 are provided at diagonal positions in compartment walls 64A, 64B opposite to each other so as to extend in the forward and backward direction.

Two communication holes 67A, 67B for communicating the internal space of the first pump room 62A and the internal space of the second pump room 62B with each other are formed in the partition wall 62C partitioning the first pump room 62A and the second pump room 62B. The opening diameter of the communication hole 67A formed on the side (upper side) of the gas suction pipe 65 is greater than that of the communication hole 67B formed on the side (lower side) of the gas discharge pipe 66, whereby the pump is so constructed that air is passed through from the side of the gas suction pipe 65 to the side of the gas discharge pipe 66 in the second pump room 62B by reciprocating operation in width direction of the diaphram 63.

The pump driving motor 70 is supported in such a manner that a rotating shaft 71 thereof extends in a direction perpendicular to the direction in which the drive shaft 63A of the pump 61 extends i.e. forward and backward direction. The drive shaft 63A of the pump 61 is connected to the rotating shaft 71 through a cam mechanism 72.

More specifically, a shaft member 73 eccentrically fixed to the rotating shaft 71 of the pump driving motor 70 is fitted in and held by the sleeve member 63B, thereby forming the cam mechanism 72 which is a power transmission device of the pump driving motor 70 for the pump 61. A connector 74A illustrated in FIG. 3 is connected to the connector 74B for connection of the pump unit mounted on the control circuit board 15.

The pump device 10 according to the present invention preferably has a performance that a gas can be fed to the portable gas alarm body 100 at a flow rate of 0.2 to 0.5 L/min, for example. As the pump 61 making up the pump unit 60, a pump having a performance that a gas discharge quantity of the pump device 10 is 0.4 to 0.45 L/min, for example, is used.

The pump 61 preferably has an ultimate vacuum of 0.6 to 0.75 Pa (80 to 100 mmHg).

<Manifold>

Figure 10:
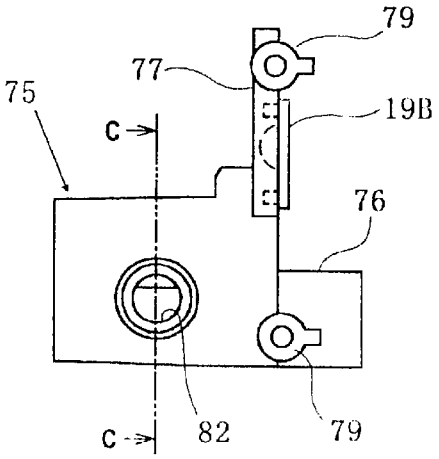
FIG. 10 is a top plan view schematically illustrating the construction of a manifold in the gas suction pump device shown in FIG. 2.
Figure 11:
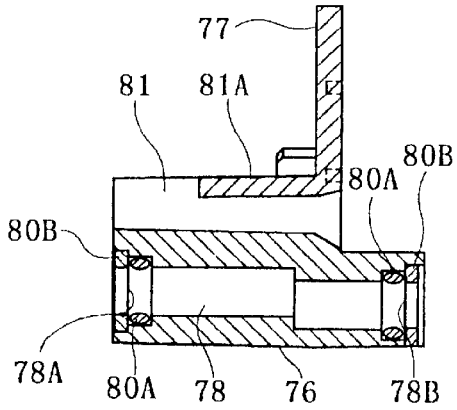
FIG. 11 is a transverse cross-sectional view of the manifold shown in FIG. 10.
Figure 12:
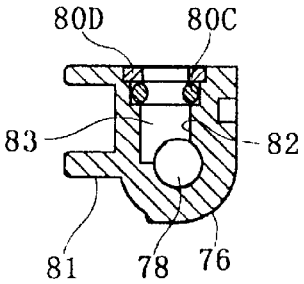
FIG. 12 is a longitudinal cross-sectional view taken along line C—C in FIG. 10.

FIG. 10 is a top plan view schematically illustrating the construction of the manifold in the gas suction pump device shown in FIG. 2, FIG. 11 is a transverse cross-sectional view of the manifold shown in FIG. 10, and FIG. 12 is a longitudinal cross-sectional view taken along line C—C in FIG. 10.

The manifold 75 which is a gas flow path forming member connecting the pump unit 60 to the gas outlet port 47A is formed by a cylindrical part 76 forming a gas flow path 78 extending in the forward and backward direction and a plate part 77 formed so as to extend from the side surface of the cylindrical part 76 to a direction (width direction) perpendicular to the direction of the gas flow path, and screw-fixing parts 79 extending upward are provided.

A front opening 78A in the gas flow path 78 of the cylindrical part 76 is connected to the gas discharge pipe 66 of the pump unit 60 and a rear opening 78B in the gas flow path 78 is connected to the small-diameter cylindrical part 48 in the gas discharge part 47, as illustrated in FIG. 2 in a state that the screw-fixing parts 79 have been fixed to the surface of the control circuit board 15 by screws 18.

Sealing members 80A, 80A such as, for example, O-rings are respectively interposed between an inner peripheral surface in the front opening portion of the cylindrical part 76 and an outer peripheral surface of the gas discharge pipe 66 of the pump unit 60, and between an inner peripheral surface in the rear opening portion of the cylindrical part 76 and an outer peripheral surface of the small-diameter cylindrical part 48 in the gas discharge part 47 to be airtightly sealed. Reference character 80B in FIG. 11 indicates a ring-like holding member for holding the sealing member 80A.

A side hole 81 opened to the rear surface of the plate part 77 is formed in a side surface in the cylindrical part 76 of the manifold 75. The blade-like support member 52 in the rear case 40 is inserted into this side hole 81, and the claw member 52A formed at the tip part of this blade-like support member 52 is interlocked with a front end edge of a compartment wall 81A for forming the side hole 81, whereby the manifold 75 is arranged in the casing 11 in a state positioned at a prescribed position.

A through-hole 82 communicating with the gas flow path 78 and opened upward is formed in the cylindrical part 76 of the manifold 75. A pressure sensor 84 is connected to a branched gas flow path 83 defined by this through-hole 82. More specifically, the pressure sensor 84 is arranged in a space defined between the cylindrical part 76 of the manifold 75 and the control circuit board 15 as illustrated in FIG. 3, to which a gas inlet pipe 84A of the pressure sensor 84 is connected in a state airtightly sealed by a sealing member 80C such as, for example, an O-ring interposed between an outer peripheral surface thereof and an inner peripheral surface of the through-hole 82 and held by a ring-like holding member 80D.

A plus-side contactor member 19B is supported on a rear surface of the plate part 77 of the manifold 75, and the plus-side contactor member 19B is inserted into the guide groove 53 in the battery fitting chamber 50 in a state that the manifold 75 has been installed in the rear case 40, thereby being connected to the battery.

In the above, the pump unit 60 is fitted to the manifold 75 in a state that the pump 61 is located in the vicinity of one side wall in the casing 11, and that the pump driving motor 70 is located in the vicinity of the other side wall, whereby a rear end part of the pump driving motor 70 is received in a space defined by the manifold 75 and the other side wall 21B in the casing 11, and so the pump unit 60 is substantially held in a state that it does not project forward from the front end edge of the control circuit board 15.

As illustrated in FIG. 5, a cylindrical filter unit fitting part 27 projecting forward from the front end edge of the front case 20 is formed in the front case 20 in the casing 11 in a state that an internal space thereof communicates with an internal space of the front case 20 through the gas inlet port 26A.

A filter unit 85 for feeding air in the objective space to perform the measurement of gases to the gas alarm device 100 in a state that dust has been removed is fitted in the filter unit fitting part 27 as illustrated in FIG. 2.

More specifically, as illustrated in FIG. 3, the filter unit 85 is composed of a cylindrical filter case 86 and a two-stage cylindrical sealing member 87 in which a rear end part of the filter case 86 is fitted, and a small-diameter cylindrical part 87A provided so as to project and extend rearward in the sealing member 87 is inserted into the gas inlet port 26A.

The filter case 86 is formed by, for example, a transparent resin, and, for example, a cotton filter material 86A is filled in the interior of the filter case 86. The filter case 86 is formed by the transparent resin, whereby the stained condition of the cotton filter material 86A filled in the interior can be visually observed from the outside to easily sense the time when the cotton filter material 86A is to be exchanged.

For example, a primary filter 88A composed of Teflon (trademark), a metal mesh 88B and a secondary filter 88C composed of Teflon (trademark) are fitted in the sealing member 87 in this order in the gas flowing direction in the forward and backward direction.

A connecting member 89 for introduction of a gas is provided at the tip part of the filter case 86, and a tip nozzle 90 is connected to the connecting member 89 for introduction.

The tip nozzle 90 is composed of, for example, a tapered tube or pipe that the outer diameter thereof gradually diminishes toward the tip thereof in the whole. With respect to a gas inlet hole 90A of the tip nozzle 90, the inner diameter also gradually diminishes toward the tip.

In FIGS. 4 and 5, reference character 26B indicates a recess in which a cushioning member 26C for supporting the pump unit 60 is fitted, 27A a fixing groove for detachably fitting the filter case 86 making up the filter unit 85, 35 a window for displaying the power source lamp formed at a position corresponding to the lamp 16A in the control circuit board 15, 36 a window for displaying the alarm lamp of the lower flow rate formed at a position corresponding to the lamp 16B, 37*a* display panel covering the window for displaying the power source lamp and the window for displaying the alarm lamp of the lower flow rate, and 38 a rotary disc-type switch for connecting the contactor members 17A, 17B mounted on the surface of the control circuit board 15 to each other by being rotated.

In FIGS. 6 and 7, reference numeral 57 indicates a fitment holding part having a through hole for installing a carrying holder such as, for example, a strap.

An example of specific numerical values of the pump device according to the present invention will be described. With respect to the pump unit 60, the inner diameters of the gas suction pipe 65 and the gas discharge pipe 66 are both 2 mm, the volume of the pump room 62 is about 1.2 $cm^3$, the eccentricity of the shaft member 66 to the rotating shaft 71 of the pump driving motor 70 is 0.9 mm, and the electromotive force of the pump driving motor 70 is 3.0 V. With respect to the gas feed-side plug 49, the opening diameter of the gas outlet port is 0.6 mm. The battery fitting chamber 50 has a cylindrical internal space for receiving a battery, whose inner diameter is 14.5 mm and whose length is 51.6 mm.

The operation of the pump device 10 of the above-described constitution will now be described.

When the switch 38 is rotated in a state that the battery has been fitted in the battery fitting chamber 50, the contactor members 17A, 17B for switch mounted on the surface of the control circuit board 15 are connected to each other, whereby a current from the battery is fed as an operating current for the respective parts through the control circuit board 15. Supply voltage is raised to 3.0 V by the control circuit board 15 to actuate the pump driving motor 70 in the pump unit 60, whereby driving power by the rotating shaft 71 of the pump driving motor 70 is transmitted to the drive shaft 63A provided at the diaphragm 63 through the cam mechanism 72, and the drive shaft 63A is driven in the upward and downward directions reciprocally by a cam action. The diaphragm 63 is thereby operated to suck air in the objective space to perform measurement of gases through the tip nozzle 90.

The air sucked through the tip nozzle 90 is introduced into the pump device 10 from the gas inlet port 26A through the filter unit 85, passed through the pump room 62 in the pump unit 60 and the gas flow path 78 in the manifold 75 and discharged in a pressurized state compared with a case where it is opened to the atmospheric air as it is due to the effect of the capillary structure of the gas feed-side plug 49.

On the other hand, an exhaust pressure from the pump unit 60 is measured by the pressure sensor 84 connected to the branched gas flow path 83 in the manifold 75, thereby detecting pressure drop when the flow rate is lowered because of, for example, suction of water or clogging of the filter. At this time, the lamp 16B for indicating an alarm of lower in flow rate is lighted, and the operation of the pump unit 60 is forcedly stopped.

Right after the power source is turned on, the operation of the pump unit 60 is not forcedly stopped even when the lower gas flow rate is detected, and the pump driving motor 70 is controled to be stopped at the time the prescribed period of time, for example, about 10 seconds have elapsed. Utilizing such operation characteristics, it can be confirmed that the pump device 10 is in a normally operating condition, by closing the gas suction port of the tip nozzle 90 with a finger or the like for a short period of time upon determination of the condition of air in the objective space to perform measurement of gases.

According to the above-described pump device 10, the casing 11 can be held by a hand, and the essential constituent members of the pump device 10 are rationally arranged in a state that a dead space in the casing 11 becomes as small as possible, whereby the pump device 10 itself can be provided as a small-sized and light-weight one while retaining basically necessary functions.

Specifically, the pump unit 60 in the pump device 10 is small in size, the driving power source is an AA size battery, and moreover (1) the pump unit 60 is arranged in such a manner that a gas flow path extending in the forward and backward direction is formed in the region on the side of one side wall in the casing 11, (2) the battery fitting chamber 50 is formed in the region on the side of the other side wall in the casing 11 to receive the battery therein, and (3) the control circuit board 15 is arranged at a position above these parts, whereby the constitutive members of the pump device 10 can be arranged in the casing 11 at a high space utilization factor. The pump device 10 itself can be thereby provided as a small-sized and light-weight one while retaining basically necessary functions.

With respect to the dimensions of the respective parts in the pump device 10 according to the present invention, for example, the whole length is about 200 mm including the tip nozzle 90 whose tip opening diameter is 4 mm and whose rear end opening diameter is 6 mm, the maximum dimension in the upward and downward direction is about 30 mm, the maximum dimension in the width direction is about 34 mm, and the weight is about 105 g including the battery. Accordingly, the pump device is excellent in portability, and so actually high convenience can be achieved.

The constitutive members of the pump device 10 can be arranged in the casing 11 at a high space utilization factor by satisfying the following constitutions (A) and (B), whereby the pump device 10 can be more miniaturized.

(A) The pump 61 making up the pump unit 60 is located on the side of one side wall of the casing 11, the pump driving motor 70 is located on the side of the other side wall of the casing 11, as well as a part of the pump driving motor 70 is arranged in a state received in a side space defined by the manifold 75 and the other side wall of the casing 11.

(B) The pressure sensor 84 is arranged on the side of the control circuit board 15, i.e., by utilizing a space defined between the manifold 75 and the control circuit board 15.

A recessed part 46 for receiving an end part of the connecting tube 95 is formed at a rear end part on the side of one side wall in the casing 11, and the gas feed-side plug 49 is fitted in the gas outlet port 47A opened in the recessed part 46, whereby the length of the gas flow path in the casing 11 can be shortened, the pump device 60 and the manifold 75 forming the gas flow path can be made small compared with a case where no recessed part 46 is formed, and moreover a joined part between the pump device 10 and the connecting tube 95 is formed within the recessed part 46, whereby the joined part can be protected, and release of the joined state between the pump device 10 and the connecting tube 95 can be prevented with certainty.

In the above-described pump device 10, the anti-detaching metal band 12 is fitted on the joined area between the front case 20 and the rear case 40, and the anti-detaching metal band 12 is fixed to the casing 11 by the screw 13, whereby exchange of, for example, the pump 61 and other maintenance works can be carried out by extremely simple work that the screw 13 is removed to remove the anti-detaching metal band 12, and the joining between the front case 20 and the rear case 40 is released, and high convenience for use is hence achieved.

<Portable Gas Alarm Device>

Figure 13:
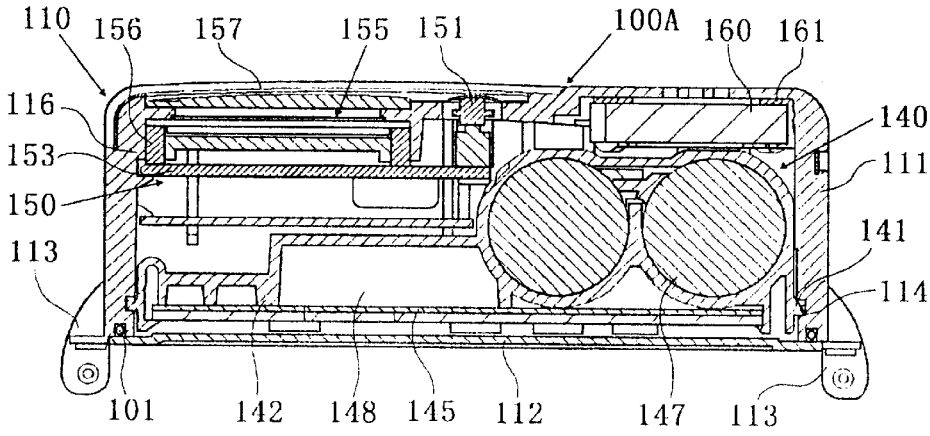
FIG. 13 is a longitudinal cross-sectional view schematically illustrating the construction of an exemplary gas alarm device to which the gas suction pump device according to the present invention is connected viewed from a direction indicated by an arrow A in FIG. 1.
Figure 14:
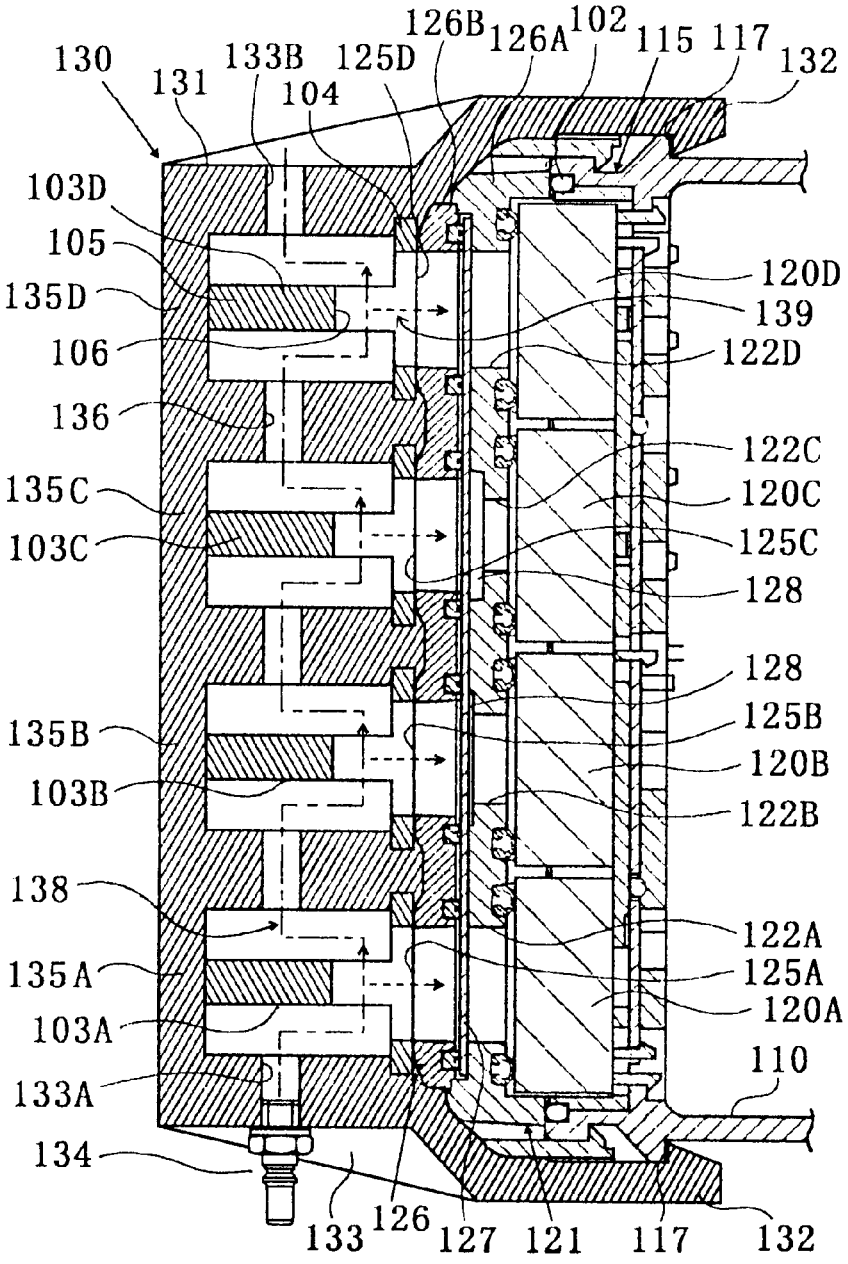
FIG. 14 is a transverse cross-sectional view schematically illustrating the construction of a gas detecting part formed at one side surface of the gas alarm device.
Figure 15:
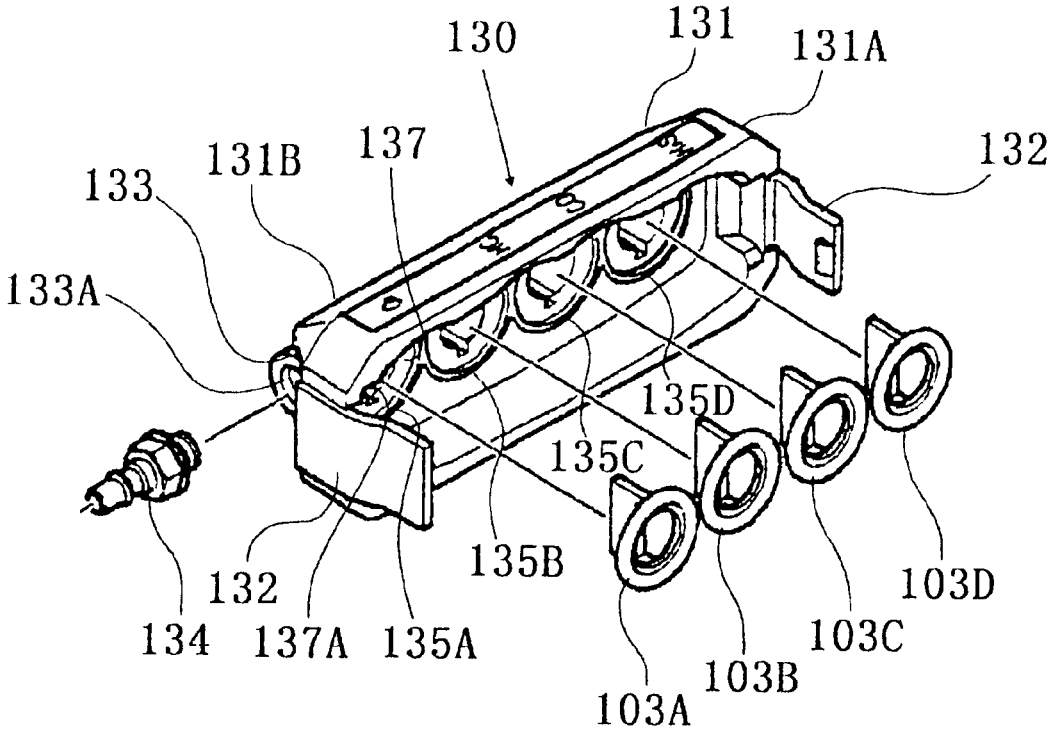
FIG. 15 is a perspective view schematically illustrating the construction of an exemplary gas feed adapter installed in a gas alarm device body.

FIG. 13 is a longitudinal cross-sectional view schematically illustrating the construction of an exemplary gas alarm device connected to the pump device according to the present invention viewed from a direction indicated by an arrow A in FIG. 1, FIG. 14 is a transverse cross-sectional view schematically illustrating the construction of a gas detecting part formed at one side surface of the portable gas alarm device, and FIG. 15 is a perspective view schematically illustrating the construction of an exemplary gas feed adapter installed in a gas alarm device body.

In this specification, the left and right direction, upward and downward direction and a direction perpendicular to the drawing in FIG. 13 are referred to as "forward and backward direction", "upward and downward direction" and "width direction", respectively.

A gas alarm device body 100A has a substantially box-like casing 110 formed by a case body 111 having an opening at a lower part and formed of, for example, a polymeric material, and a conductive lid 112 joined and fixed to the opening part in the case body 111 by a plurality of screws (not illustrated) with a sealing member 101 composed of a ring-like packing therebetween. Fitting member fixing parts 113 in which a fitting member (not illustrated) such as, for example, a band for fitting on a person's body to carry the gas alarm device body 100A is installed are respectively formed at lower end parts in the front end edge and rear end edge of the casing 110.

As illustrated in FIG. 1, a gas detecting part is formed along one side surface (side surface on an inmost side in FIG. 13) of the casing 110 in such a manner that a plurality of gas sensors, which detect gases of different kinds from each other, are arranged side by side in a plane direction of said one side surface.

A charging terminal 107 for charging a secondary battery 147 as a driving power source, which will be described subsequently, and a communication terminal 108 for transmitting a gas concentration data detected by the gas sensors are provided at the other side surface in the casing 110.

In FIG. 1, reference numeral 152 indicates a light emitting part for alarm which raises an alarm by light emission.

A power unit 140 composed of a flat plate-like circuit board 145, on which the charging terminal 107, the secondary battery 147, a current limiting resistance 148 and other various necessary functional elements are mounted, and an insulating cover member 142 provided integrally with the circuit board 145 to cover the whole surface of the circuit board 145 is arranged in the casing 110 in such a manner that the circuit board 145 extends in parallel with the conductive lid 112 in the forward and backward direction. Fixing claw parts 141 respectively formed so as to extend downward at the front end part and rear end part of the insulating cover member 142 are engaged with and fixed to recessed parts 114 formed in an inner wall surface of the case body 111.

A panel-like display mechanism 155 composed of a liquid crystal display panel and an alarm buzzer 160 making up an alarm annunciating mechanism are arranged on the upper side of the power unit 140 so as to stand in a plane direction (forward and backward direction) of the circuit board 145, and the alarm buzzer 160 is contained in a cylindrical buzzer holding part 161 formed in the case body 111 in a state located over the secondary battery 147 in the power unit 140.

A signal processing unit 150 composed of a control circuit board 153, on which a memory element for saving log data, an external operation switch 151, a light emitting element for alarm and other various necessary functional elements are mounted, is arranged under the panel-like display mechanism 155, and the panel-like display mechanism 155 is connected to the control circuit board 153 through a plate-like conductive member 156 composed of anisotropically conductive rubber.

A window plate 157 for protection is arranged over the panel-like display mechanism 155.

A light guide plate is provided at a position under the panel-like display mechanism 155, and a back light composed of a light emitting diode (not illustrated) that the panel-like display mechanism 155 is irradiated with light through the light guide plate is provided.

The conductive member 156 exhibits conductivity in the upward and downward direction, and the control circuit board 153 is held fixedly by a holding part 116 formed in the case body 111 in a state that the conductive member 156 has been pressed in the upward and downward direction, whereby the panel-like display mechanism 155 is electrically connected to the control circuit board 153.

As described above, a gas detecting part is formed at one side surface in the gas alarm device body 100A in such a manner that a plurality of the gas sensors, which detect gases of different kinds from one another, are arranged side by side in a plane direction of said one side surface.

As illustrated in FIG. 14, a sensor holding part 115 which holds a plurality of gas sensors on one side surface of the casing 110 is formed in the gas detecting part 121. Four (4) button type gas sensors 120A to 120D, for example, which detect the objective gases to be detected of different kinds from one another, are contained in this sensor holding part 115, and fixed and held by a gas sensor fixing frame member 126 detachably engaged with the sensor holding part 115 through a sealing member 102.

As the gas sensors 120A to 120D, any gas sensor elements may be used according to the kinds of the objective gases to be detected. As examples thereof, may be mentioned a galvani cell type gas sensor element which detects oxygen gas, a potentiostatic electrolysis type gas sensor element which detects carbon monoxide gas, a potentiostatic electrolysis type gas sensor element which detects hydrogen sulfide gas, and a catalytic combustion type gas sensor element which detects hydrocarbon gases.

The gas sensor fixing frame member 126 is formed by engaging or interlocking integrally a sensor fixing frame 126A, a first fixing frame, and a filter fixing frame 126B, a second fixing frame, with each other, and through-holes 122A to 122D are formed corresponding to the respective gas sensors 120A to 120D, whereby gas inlet ports 125A to 125D as to the respective gas sensors 120A to 120D are formed independent of one another.

A dust protective filter 127 which removes dust contained in the air being introduced in the gas sensors and is common to the gas sensors 120A to 120D is interposed between the sensor fixing frame 126A and the filter fixing frame 126B.

Since the gas sensors 120A to 120D may be affected by interfering gases according to the kinds of the gases to be detected, for example, hydrocarbon gases or carbon monoxide gas, a filter 128 for removing interfering gases is interposed between the sensor fixing frame 126A and the dust protective filter 127.

The gas sensor fixing frame member 126 engaged with and detachably installed in the casing 110 in the above-described manner is fixed to the casing 110 by screws (not illustrated), whereby the gas sensors 120A to 120D can be exchanged by extremely simple work that the screws are removed to remove the gas sensor fixing frame member 126 from the casing 110 when the sensitivity of the gas sensors 120A to 120D is lowered due to, for example, long-term service. When the functions of the dust protective filter 127 and the filter 128 for removing interfering gases are lowered, such filters 127, 128 can also be exchanged by extremely simple work.

A gas feed adapter 130 is detachably installed in the casing 110 of the gas alarm device body 100A in a state covering the gas detecting part 121 outside the gas sensor fixing frame member 126 in the gas alarm device body 100A.

As illustrated in FIG. 15, the gas feed adapter 130 is equipped with a casing 131 composed of a frame part 131A in which the gas sensor fixing frame member 126 in the gas alarm device body 100A should be contained, and a tapered part 131B formed so as to extend outward in the width direction in continuity with the frame part 131A. Engaging claws 132, 132 detachably engaged with the gas alarm device body 100A are respectively formed in the front end wall and rear end wall of the frame part 131A of the casing 131 so as to extend inward in the width direction. The engaging claws 132, 132 are engaged with engaging grooves 117, 117 formed in the front wall and rear wall of the casing 110 in the gas alarm device body 100A, whereby attachable and detachable state is retained.

A recessed part 133 for arranging a connecting terminal connected to the connecting tube 95, in which a gas feed port 133A opened forward has been formed, is formed in the front end part in the tapered part 131B of the casing 131. A gas inlet-side plug 134 which is the connecting terminal is installed in the gas feed port 133A so as to project forward.

A gas outlet port 133B which communicates the internal space in the casing 131 to the air is formed at a diagonal position to the gas feed port 133A in the rear end part in the tapered part 131B so as to open backward.

On the internal side of the tapered part 131B of the casing 131, 4 cylindrical parts 135A to 135D extending in the width direction are formed at positions corresponding to the gas sensors 120A to 120D of the gas alarm device body 100A so as to successively stand in the forward and backward direction in an integrally joined state.

In the cylindrical parts 135A to 135D, communication holes 136 for communicating the internal spaces thereof successively are respectively formed, thereby forming a gas inlet passage extending linearly in the forward and backward direction, and communicating with the gas feed port 133A and the gas discharge port 133B.

In each of the cylindrical parts 135A to 135D, circular recessed portions 137 are respectively formed at the end surfaces on the internal side, whereby sealing member holding parts in which sealing members 103A to 103D are respectively received and held are formed.

Figure 16:
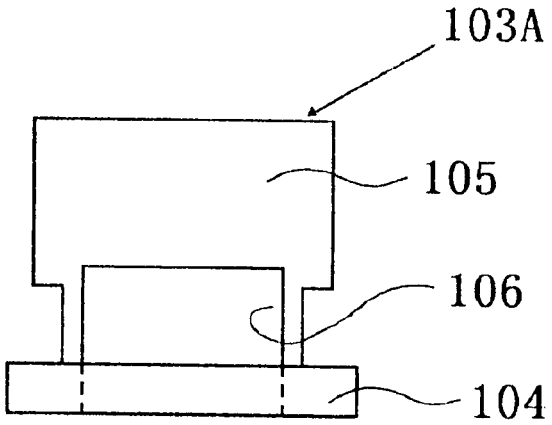
FIG. 16 is a front elevation of a sealing member used in the gas feed adapter.

As illustrated in FIG. 16, the sealing member 103A is formed by a ring-like part 104 and a plate part 105 extending outward in continuity with the outer end surface of the ring-like part 104, and the sealing member 103A is held by the sealing member holding part in a state inserted along a groove part 137A for insertion formed in such a manner that the plate part 105 extends in the width direction at both upper end part and lower end part in the inner peripheral surface of the cylindrical part 135.

In the plate part 105 in the sealing member 103A, a hole 106 for passing air introduced into the gas feed adapter 130 through in a state received in the sealing member holding part is formed at a position in the vicinity of the ring-like part 104.

The other sealing members 103B to 103D are also constructed in the same manner as in the sealing member 103A.

Accordingly, the sealing members 103A to 103D are respectively held by the sealing member holding parts in the cylindrical parts 135A to 135D, whereby the plate part 105 in each sealing member functions as a so-called baffle that prevents air from being passed through directly from the gas feed port 133A to the gas discharge port 133B, and a zigzag main gas inlet passage 138 (indicated by an alternate long and short dash line in FIG. 14) extending in the forward and backward direction as a whole is formed.

The internal spaces in the cylindrical parts 135A to 135D are respectively airtightly communicated with the gas inlet ports 125A to 125D independent of one another in the gas sensor fixing frame member 126 through the sealing members 103A to 103D, whereby 4 branched gas inlet passages 139 (indicated by a broken line in FIG. 14) independent of one another for respectively introducing air in the objective space to perform gas measurement in the gas sensors 120A to 120D in the gas alarm device body 100A are formed.

The operation of the portable gas alarm device of the above-described constitution will be described.

When the portable gas alarm device 100 is operated, the respective gas sensors 120A to 120D and the panel-like display mechanism 155 are being operated. In this state, the pump device 10 connected to the potable gas alarm device 100 is driven, whereby air in the objective space to perform gas measurement is fed into the gas feed adapter 130 through the connecting tube 95, passed through along the zigzag main gas inlet passage 138 in the gas feed adapter 130 while flowing through the respective branched gas inlet passages 139 and then discharged from the gas outlet port 133B. Accordingly, the air fed into the gas feed adapter 130 by the pump device 10 is introduced into the respective gas sensors 120A to 120D making up the gas detecting part 121 in substantially the same state as the state that the air in the objective space to perform gas measurement reaches the gas detecting part 121 by diffusion, whereby the concentrations of the objective gases to be detected are detected.

The concentrations of the objective gases to be detected by the gas sensors 120A to 120D are sent as current signals or voltage signals to the signal processing unit 150 to be processed. The gas concentrations at each time are stored in a memory device, and the concentration of any gas selected by the external operation switch 151 is displayed by the panel-like display mechanism 155. The time can be displayed by operating the external operation switch 151 as needed.

An alarm actuating signal is generated when the concentration of the objective gas to be detected exceeds the reference value preset as to such a gas, thereby driving an alarm annunciating mechanism to raise an alarm.

For example, when the objective gas to be detected is oxygen gas ($O_2$ gas), the reference value is determined to be 18.0 vol. % by way of example, and an alarm actuating signal is outputted when the concentration becomes a value lower than this reference value. The reference value is determined to be 10% LEL (gas concentration of lower explosion limit) by way of example when the objective gas to be detected is a hydrocarbon gas (HC gas). The reference value is determined to be 25 ppm by way of example when the objective gas to be detected is carbon monoxide gas (CO gas), while the reference value is determined to be 10 ppm by way of example when the objective gas to be detected is hydrogen sulfide gas ($H_2S$ gas). An alarm actuating signal is generated when the concentration exceeds each reference value.

In the illustrated embodiment, the alarm buzzer 160 and a light emitting element for alarm are provided as alarm annunciating mechanisms, and an alarm is raised by buzzer sound and light emission.

The alarm annunciating mechanism can be constructed by providing a vibration generator for alarm, which generates low frequency wave of about several tens Hz. In this case, an alarm is raised by buzzer sound by the alarm buzzer 160, light emission by the light emitting element for alarm and vibration by the vibration generator for alarm.

When plural kinds of alarm annunciating mechanisms are provided as described above, it is not necessary to drive all the alarm annunciating mechanisms at the same time, and it is preferable to conduct a cyclic alarm operation that the respective alarm annunciating mechanisms are successively driven only for a predetermined period of time. According to such drive control, the consumption of the battery can be inhibited compared with the case where all or a plural of the alarm annunciating mechanisms are driven at the same time.

According to the above-described portable gas alarm device 100, the gas detecting part 121 is formed at one side surface of the casing 110 making up the gas alarm device body 100A, and the charging terminal 107 and the communication terminal 108 are provided at the other side surface, whereby calibration operation of the gas sensors 120A to 120D can be performed by feeding a standard gas from one side part, and at the same time, the secondary battery 147 as a driving power source can be charged without obstacle to practice the calibration operation of the gas sensors 120A to 120D.

The portable gas alarm device 100 is basically fitted on a person's body by the fitting member such as a band and carried together with its body by the person. Accordingly, when the environmental atmosphere of the person becomes a dangerous state due to high concentration of the dangerous gas contained or low oxygen gas concentration, that the condition is annunciated by the display of the panel-like display mechanism 155, and light emission of the light emission part 152 for alarm, buzzing of the alarm buzzer 160 and operation of the vibration generator for alarm. Accordingly, the person can immediately dispatch, take proper protective means, or take some counter measure such as evacuation from such a site.

The above-described portable gas alarm device 100 can detect dangerous gases contained in air in the objective space to perform gas measurement by diffusion as it is. According to the gas alarm unit constructed by fitting such a gas feed adapter 130 and connecting the pump device 100 according to the present invention by the connecting tube 95 as described above, however, the portable gas alarm device 100 is fitted on a person's body and carried together with its body by the person, and the pump device 10 is used in a state held by a hand, whereby such a gas alarm unit has extremely high convenience for use as a portable gas alarm unit as to dangerous gases in specific spaces.

Accordingly, prescribed gas detection can be performed by pointing, for example, the tip nozzle of the pump device 10 to the intended place, so that concentration measurement of dangerous gases can be performed even in a place where no person can enter, and high safety can be kept.

According to the above-described gas feed adapter 130, a state substantially equal to natural diffusion can be realized because the main gas inlet passage 138 for feeding air in the objective space to perform gas measurement to the gas detecting part 121 of the gas alarm device body 100A is opened to the atmospheric air though the air is forcedly introduced by the pump device 10. In addition, the main gas inlet passage 138 is formed so as to extend zigzag, and the branched gas inlet passages 139 are formed corresponding to the respective gas sensors 120A to 120D, whereby air introduced by pump device 10 can be surely fed to the respective gas sensors 120A to 120D.

Although the embodiments of the present invention have been described above, various changes and modifications may be added thereto without being limited to the above embodiments.

For example, specific constructions of the respective parts in the actual pump device, for example, the gas discharge quantity and other performance of the pump, the internal dimensions of the gas flow path formed in the casing or gas flow rate, the opening diameter of the gas discharge port of the gas feed-side plug and other constitutions can be suitably changed as necessary for the end application intended.

A tube having a length of 8 to 10 m, to the tip of which a float has been connected in place of the tip nozzle, can be selectively connected. According to such a construction, when the condition of air in the objective space to perform gas measurement, such as a place where water stays, space within a manhole, for example, is determined, the prescribed determination or measurement can be performed with certainty without sucking water into the pump device by throwing the float in such a place.

What is claimed is:

1. A gas suction pump device suitable for use in being connected by a connecting tube to a portable gas alarm device, which comprises:

a casing having a substantially rectangular framelike sectional shape having two side walls opposite to each other, and upper and lower walls which connect the side walls to each other, and formed slenderly in a gas flowing direction and into a size holdable by grasping with a hand;

a control circuit board provided in the casing so as to extend in a longitudinal direction along the upper wall;

a pump unit arranged in a region on the side of one side wall under the control circuit board, in which one end and the other end of a gas flow path defined by the pump unit and extending in the longitudinal direction of the casing communicate with a gas inlet port opened forward of the casing and a gas outlet port opened backward of the casing, respectively; and a battery fitting chamber provided in a region on the side of the other side wall.

2. The gas suction pump device according to claim 1, wherein the pump unit comprises a pump and a pump driving motor provided integrally with the pump, and wherein the pump is located in the vicinity of one side wall in the casing, and the pump driving motor is arranged in a state located in the vicinity of the other side wall.

3. The gas suction pump device according to claim 2, wherein the pump of the pump unit has a gas discharge quantity of 0.2 to 0.5 L/min.

4. The gas suction pump device according to claim 1, wherein a driving power source comprises a battery.

5. The gas suction pump device according to claim 1, wherein a recessed part for receiving an end part of the connecting tube is formed in the casing, and a connecting terminal to which the connecting tube is connected is provided at the gas outlet port in the recessed part in a state projected backward from the rear wall thereof.

6. The gas suction pump device according to claim 1, wherein a branched gas flow path opened upward is defined in a gas flow path forming member connecting the pump unit to the gas outlet port, and a pressure sensor is connected to the branched gas flow path in a state arranged on the control circuit board side of the gas flow path forming member.

7. The gas suction pump device according to claim 1, wherein the casing is formed by joining a front case with a rear case detachably to each other, and an anti-detaching metal band for preventing both front case and rear case from detaching from each other is fitted on the joined area between the front case and the rear case.

8. The gas suction pump device according to claim 7, wherein the anti-detaching metal band is fitted in a state that both ends thereof overlap each other and fixed to the casing by a screw at a position where both ends overlap each other.

9. A gas feed adapter for connecting the gas suction pump device according to claim 1 through a connecting tube to a portable gas alarm device equipped with a plurality of gas sensors which detect gases of different kinds from one another, which comprises:

a casing having an engaging part and detachably engaged with a gas alarm device body, wherein a gas feed port common to the respective gas sensors in the gas alarm device body is defined in one outer end wall of the casing, a connecting terminal to which the connecting tube is connected is also fitted so as to project outward, and a gas outlet for opening the internal space in the casing to the air is defined in the other outer end wall, and wherein:

a main gas inlet passage extending in a zigzag manner from the gas feed port to the gas outlet is formed in the casing, and a plurality of branched gas inlet passages independent of one another for introducing air in the objective space to perform the measurement of gases into the respective gas sensors in the gas alarm device body are formed in the main gas inlet passage.

10. The gas suction pump device according to claim 2, wherein a driving power source comprises a battery.

11. The gas suction pump device according to claim 3, wherein a driving power source comprises a battery.

12. A gas alarm unit comprising:

a gas suction pump device, suitable for use in being connected by a connecting tube to a portable gas alarm device, which comprises:

a casing having a substantially rectangular framelike sectional shape having two side walls opposite to each other, and upper and lower walls which connect the side walls to each other, and formed slenderly in a gas flowing direction and into a size holdable by grasping with a hand; a control circuit board provided in the casing so as to extend in a longitudinal direction along the upper wall; a pump unit arranged in a region on the side of one side wall under the control circuit board, in which one end and the other end of a gas flow path defined by the pump unit and extending in the longitudinal direction of the casing communicate with a gas inlet port opened forward of the casing and a gas outlet port opened backward of the casing, respectively; and a battery fitting chamber provided in a region on the side of the other side wall, a connecting tube connected to the gas suction pump device at an end thereof; and a portable gas alarm device connected to the other end of the connecting tube through a gas feed adapter for connecting the gas suction pump device through a connecting tube to a portable gas alarm device equipped with a plurality of gas sensors which detect gases of different kinds from one another, said gas feed adapter including:

a casing having an engaging part and detachably engaged with a gas alarm device body, wherein a gas feed port common to the respective gas sensors in the gas alarm device body is defined in one outer end wall of the casing, a connecting terminal to which the connecting tube is connected is also fitted so as to project outward, and a gas outlet for opening the internal space in the casing to the air is defined in the other outer end wall, and wherein:

a main gas inlet passage extending in a zigzag manner from the gas feed port to the gas outlet is formed in the casing, and a plurality of branched gas inlet passages independent of one another for introducing air in the objective space to perform the measurement of gases into the respective gas sensors in the gas alarm device body are formed in the main gas inlet passage, and wherein air in the objective space to perform the measurement of gases is introduced from the gas suction pump device into the portable gas alarm device.

13. The gas alarm unit according to claim 12, wherein the portable gas alarm device further comprises a substantially boxlike casing which includes a case body provided with a fitting member fixing part in which a fitting member for fitting on a person's body to carry the alarm device is installed and having an opening at a lower part, and a lid for closing the opening in the case body, and a gas detecting part is formed at one planar side surface of the casing in such a manner that a plurality of the gas sensors are arranged side by side parallel to a planar direction of said one planar side surface.

14. The gas alarm unit according to the claim 13, wherein a power unit comprising a planar circuit board, on which a secondary battery as a driving power source, a charging terminal for charging the secondary battery and a current limiting resistance are mounted, and an insulating cover provided so as to cover the secondary battery and the current limiting resistance on the circuit board is provided in the casing in such a manner that the circuit board extends in parallel with the lid in the casing, and wherein:

an alarm annunciating mechanism that raises an alarm when the concentration of a gas detected by the gas sensor exceeds a reference value preset about the gas, and a display mechanism for displaying the concentration of the gas detected by the gas sensor are arranged so as to be parallel with the planar circuit board in a state that the alarm annunciating mechanism is located over the secondary battery in the power unit.

15. The gas alarm unit according to claim 13, wherein a plurality of the gas sensors are fixed and held by a gas sensor fixing frame member, in which gas inlet ports for the respective gas sensors have been formed in a state independent of one another, in the gas detecting part.

16. The gas alarm unit according to claim 13, wherein four gas sensors are arranged in the gas detecting part, and the objective gases to be detected by the gas sensors are gases of oxygen, hydrogen sulfide, carbon monoxide and hydrocarbon.

17. The gas alarm unit according to claim 14, wherein a plurality of the gas sensors are fixed and held by a gas sensor fixing frame member, in which gas inlet ports for the respective gas sensors have been formed in a state independent of one another, in the gas detecting part.

18. The gas alarm unit according to claim 14, wherein four gas sensors are arranged in the gas detecting part, and the objective gases to be detected by the gas sensors are gases of oxygen, hydrogen sulfide, carbon monoxide and hydrocarbon.

19. The gas alarm unit according to claim wherein 15, wherein four gas sensors are arranged in the gas detecting part, and the objective gases to be detected by the gas sensors are gases of oxygen, hydrogen sulfide, carbon monoxide and hydrocarbon.

20. The gas alarm unit according to claim 17, wherein four gas sensors are arranged in the gas detecting part, and the objective gases to be detected by the gas sensors are gases of oxygen, hydrogen sulfide, carbon monoxide and hydrocarbon.

* * * * *